US008025549B2

(12) United States Patent
Kim

(10) Patent No.: US 8,025,549 B2
(45) Date of Patent: Sep. 27, 2011

(54) HULA-HOOP FOR PRESSING FLESH OF WAIST IN VERTICAL DIRECTION

(76) Inventor: Yong-Jae Kim, Seoul (KR)

( * ) Notice: Subject to any disclaimer, the term of this patent is extended or adjusted under 35 U.S.C. 154(b) by 284 days.

(21) Appl. No.: 11/996,050

(22) PCT Filed: Oct. 2, 2006

(86) PCT No.: PCT/KR2006/003982

§ 371 (c)(1),
(2), (4) Date: Jan. 17, 2008

(87) PCT Pub. No.: WO2007/040337

PCT Pub. Date: Apr. 12, 2007

(65) Prior Publication Data

US 2008/0220691 A1 Sep. 11, 2008

(30) Foreign Application Priority Data

Oct. 1, 2005 (KR) ..... 10-2005-0092644

(51) Int. Cl.
*A63H 1/00* (2006.01)

(52) U.S. Cl. ..... 446/236; 446/92; 446/107

(58) Field of Classification Search ..... 446/92, 446/107, 236

See application file for complete search history.

(56) References Cited

U.S. PATENT DOCUMENTS

| | | | | |
|---|---|---|---|---|
| 4,052,982 | A * | 10/1977 | Ozeryansky | 601/121 |
| 4,898,392 | A * | 2/1990 | Goletz | 273/336 |
| 6,217,482 | B1 | 4/2001 | Yoo et al. | |
| 6,241,693 | B1 * | 6/2001 | Lambden | 601/15 |
| 6,309,273 | B1 * | 10/2001 | Kim | 446/28 |
| D450,097 | S * | 11/2001 | Seo | D21/457 |
| D458,651 | S * | 6/2002 | Lee | D21/457 |
| 6,533,635 | B1 * | 3/2003 | Chern | 446/236 |
| 2002/0155781 | A1 * | 10/2002 | Lee | 446/236 |
| 2005/0070202 | A1 * | 3/2005 | Mendel | 446/236 |
| 2005/0170739 | A1 * | 8/2005 | Zoellner | 446/92 |
| 2009/0104840 | A1 * | 4/2009 | Kim | 446/236 |

FOREIGN PATENT DOCUMENTS

| | | |
|---|---|---|
| JP | 2002-541998 | 12/2002 |
| KR | 20-2000-0020046 | 11/2000 |
| KR | 20-0210351 | 1/2001 |
| KR | 10-2001-0091714 | 10/2001 |
| KR | 10-2002-0007665 | 1/2002 |

* cited by examiner

*Primary Examiner* — Gene Kim

*Assistant Examiner* — Joseph B Baldori

(74) *Attorney, Agent, or Firm* — IPLA P.A.; James E. Bame

(57) ABSTRACT

Disclosed herein is a hula-hoop, which applies pressing force in a vertical direction as well as in a horizontal direction when the hula-hoop is rotated, thus achieving a good exercise effect, and which performs an acupressure action and a compression action using acupressure protrusions. The hula-hoop includes first and second rings (10, 20). Protruding parts (11, 21) and grooves (12, 22) are alternately provided on the first and second rings (10, 20). Streamlined body pressing space (30) is defined between the grooves (12, 22) by attaching inward protruding parts (11, 21) to each other, so that the waist flesh (h) is pinched between the grooves, thus providing pressing force in a vertical direction.

6 Claims, 9 Drawing Sheets

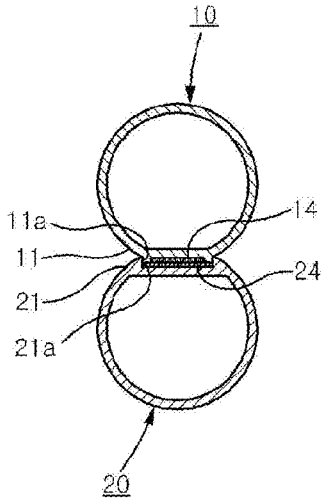
Fig. 4d
Fig. 5a
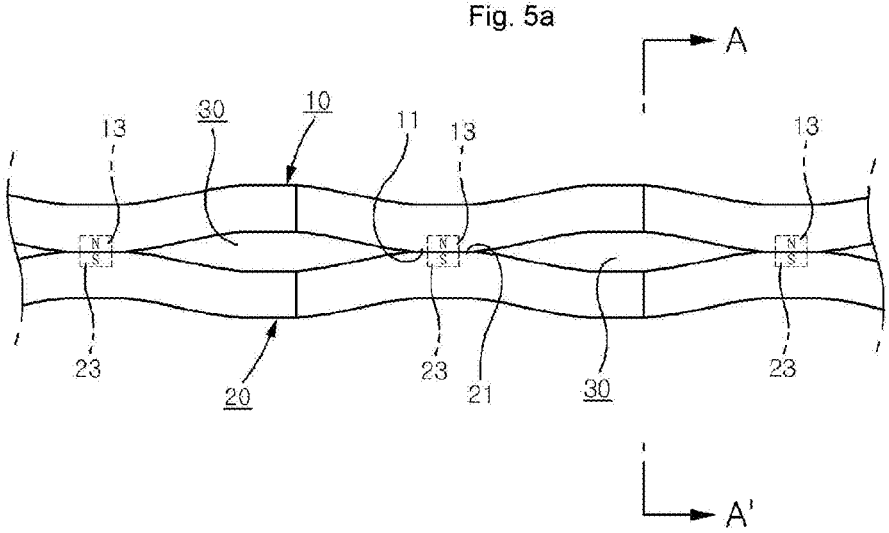
Fig. 5b
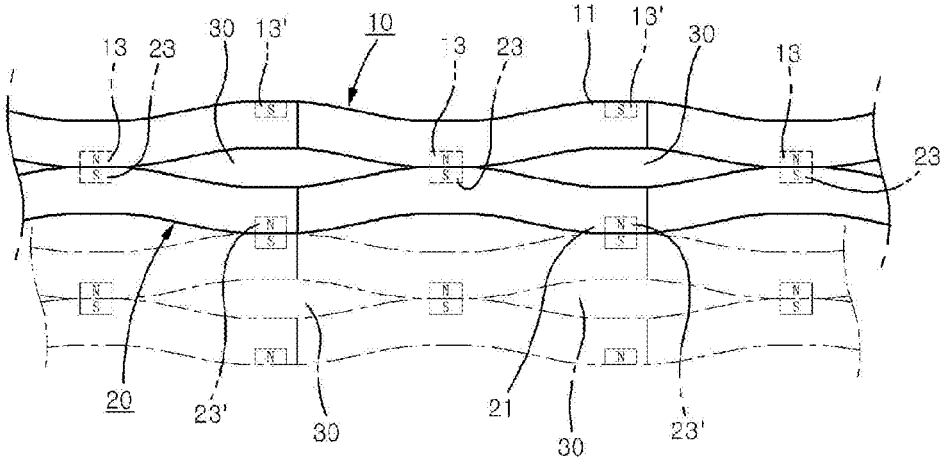

HULA-HOOP FOR PRESSING FLESH OF WAIST IN VERTICAL DIRECTION

TECHNICAL FIELD

The present invention relates generally to a hula-hoop and, more particularly, to an improved hula-hoop for pressing the flesh of the waist in a vertical direction, which is constructed so that the flesh of the waist is pinched in the vertical direction while a user exercises his or her waist using the hula-hoop, thus achieving a superior effect of exercising the waist.

BACKGROUND ART

Generally, the term "hula-hoop" refers to equipment for playing or improving health by turning a ring-shaped hoop around the hips, as in a hula-dance. The hula-hoop is used as waist exercise equipment for strengthening the muscles of the waist.

The hula-hoop usually has the shape of a simple ring. In addition, a hula-hoop having on the inner circumferential surface thereof acupressure protrusions has become widely popular.

When the hula-hoop is rotated, the waist is pressed or massaged in a horizontal direction, but no pressing force acts on the waist in a vertical direction.

More improved hula-hoops are disclosed in Korean U.M. Registration No. 20-0210351 and No. 20-0249553. In Korean U.M. Registration No. 20-0210351, two ring-shaped hula-hoops are coupled to each other. Meanwhile, in Korean U.M. Registration No. 20-0249553, a hula-hoop is constructed to have a wavy shape, thus increasing the area of contact with the waist.

The conventional hula-hoops are advantageous in that the area of contact with the body (waist) is increased when the hula-hoop is rotated. However, the conventional hula-hoops are problematic in that no pressing force acts in a vertical direction, but pressing force acts only in a horizontal direction, as in the prior art.

DISCLOSURE OF INVENTION

Technical Problem

Accordingly, the present invention has been made keeping in mind the above problems occurring in the prior art, and an object of the present invention is to provide a hula-hoop, which applies pressing force in a vertical direction as well as in a horizontal direction when the hula-hoop is rotated, thus achieving a good exercise effect.

Another object of the present invention is to provide a hula-hoop, which performs a pressing action in a vertical direction, and an acupressure action and a compression action using acupressure protrusions.

Technical Solution

In order to accomplish the above objects, the present invention provides a hula-hoop for pressing the flesh of the waist in a vertical direction, including first and second rings, protruding parts and grooves alternately provided on the first and second rings, and streamlined body pressing space defined between the grooves by attaching inward protruding parts to each other, so that the waist flesh is pinched between the grooves, thus providing pressing force in a vertical direction.

A means for attaching the inward protruding parts is first magnetic members secured to the first and second rings such that opposite magnetic poles are exposed, and second magnetic members are provided on outward protruding parts such that magnetic poles opposite the magnetic poles of the first magnetic members are exposed, and third magnetic members are provided on the grooves such that magnetic poles which are the same as the magnetic poles of the first and second magnetic members secured to the protruding parts provided on opposite sides of the grooves are exposed.

Thin non-woven fabric is attached to a surface of each of the first, second, and third magnetic members to prevent slippage.

The protruding parts are attached by magic tape.

Each of the first and second rings has on an inner circumferential surface thereof a plurality of acupressure protrusions, each of the acupressure protrusions including an acupressure head, a helical shaft extending rearwards from the acupressure head, and a stopper provided on an end of the helical shaft.

A height of each of the acupressure protrusions protruding from the inner circumferential surface of each of the first and second rings is adjusted to protrude only in each of the protruding parts.

BRIEF DESCRIPTION OF THE DRAWINGS

FIGS. 4*a* to 4*d* are sectional views showing embodiments of means of attaching protruding parts, according to the present invention;

FIGS. 5*a* and 5*b* are front views showing the attached state of the hula-hoop, according to the present invention;

MODE FOR THE INVENTION

The present invention will be described in detail with reference to the accompanying drawings.

Figure 1:
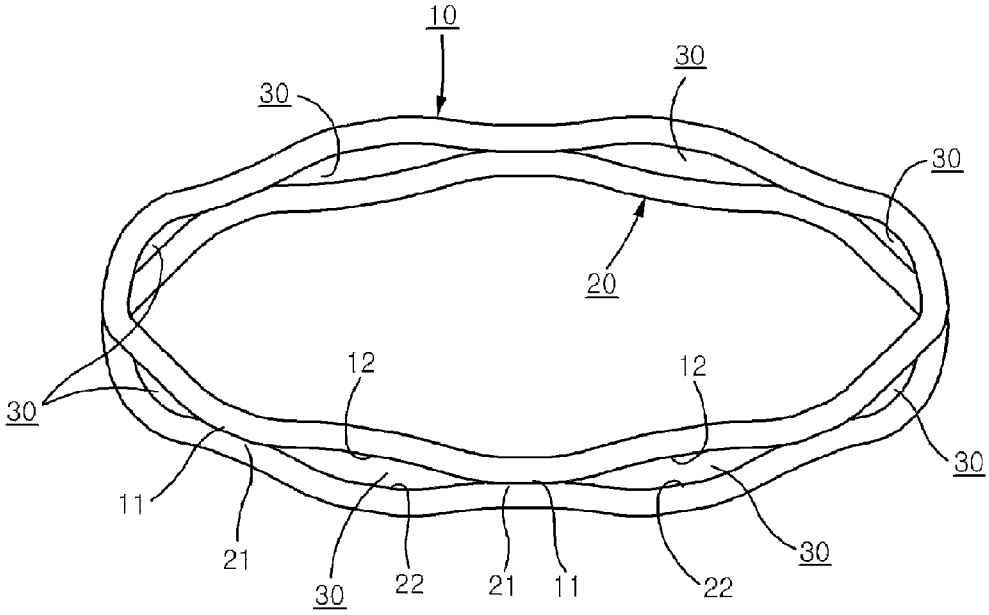
FIG. 1 is a perspective view showing a hula-hoop, according to the present invention.
Figure 2:
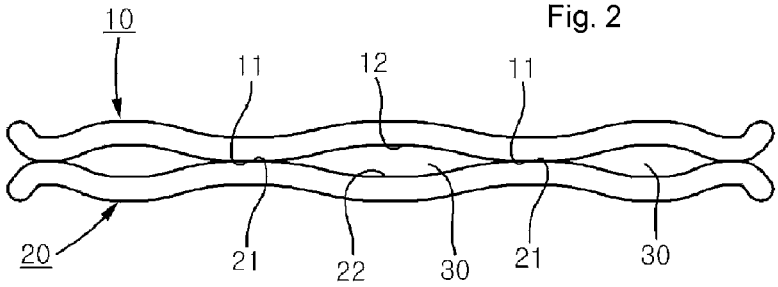
FIG. 2 is a front view showing the hula-hoop, according to the present invention.

FIG. 1 is a perspective view showing a hula-hoop, according to the present invention, and FIG. 2 is a front view of the hula-hoop. The hula-hoop according to the present invention has a ring shape overall, and is provided with a first ring 10 and a second ring 20. As seen from the front, protruding parts 11 and 21 and grooves 12 and 22 are provided on the first ring 10 and the second ring 20 in a vertical direction such that the protruding parts and the grooves alternate with each other.

Further, body pressing spaces 30, each having a streamlined shape, are defined between the first ring 10 and the second ring 20, and are formed at regular intervals. Herein, the first ring 10 and the second ring 20 may be referred to as the first and second rings 10 and 20.

In order to form the body pressing spaces 30, the first and second rings 10 and 20 are attached to each other such that the protrusions 11 and 21 thereof contact each other. Thereby, the streamlined body pressing space 30 is formed between the grooves 12 and 22.

Figure 3:
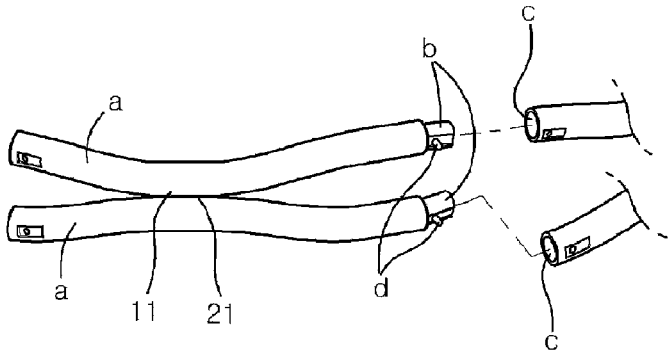
FIG. 3 is an exploded perspective view and a sectional plan view illustrating the process of manufacturing the hula-hoop, according to the present invention.

It is most preferable that the first and second rings 10 and 20 be integrated with each other in a single structure. However. such a construction requires a very large mold, which is not easy to handle, and which increases the manufacturing cost, and thus the end price to a consumer. Thus, the first and second rings 10 and 20 are divided into several ring pieces. As shown in FIG. 3, a locking projection b is provided on the end of each piece a, and is inserted into a locking hole c of another piece a. Thereafter, the pieces are assembled so that they do not become undesirably separated from each other by elastic projections d which are projected outward by the elastic force of a spring (not shown).

Further, the first ring 10 and the second ring 20 may be separately manufactured, and the protruding parts 11 and 21 may be attached to each other via attachment means.

FIGS. 4*a* to 4*e* are vertical sectional views showing the attachment means.

Figure 4A:
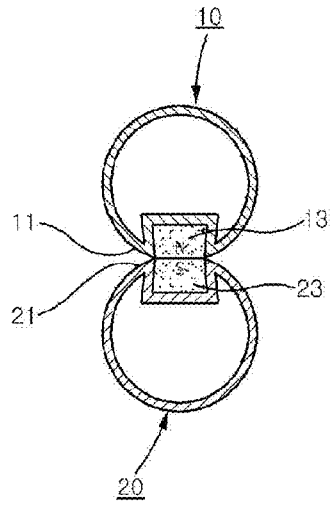

Referring to FIG. 4*a*, the protruding parts 11 and 21 are formed through insert molding such that magnetic members 13 and 23 are embedded in respective protruding parts 11 and 21, and only one surface of each magnetic member 13 or 23 is exposed to the outside.

In this case, the magnetic member 13 provided on each protruding part 11 of the first ring 10 is formed such that an N-pole is exposed to the outside, and the magnetic member 23 provided on each protruding part 21 of the second ring 20 is formed such that an S-pole is exposed to the outside. Thereby, the magnetic members are attached to each other by magnetic force. Of course, the poles of the magnetic members 13 and 23 may be the opposite of the above-mentioned case.

Parts having very strong magnetic force are used as the magnetic members 13 and 23, so that they are not separated from each other unless a very strong external force acts on the magnetic members 13 and 23. Preferably, each of the magnetic members 13 and 23 comprises a solid magnet. However, a rubber magnet, which is harmless to humans, may be used as each magnetic member.

Figure 4B:
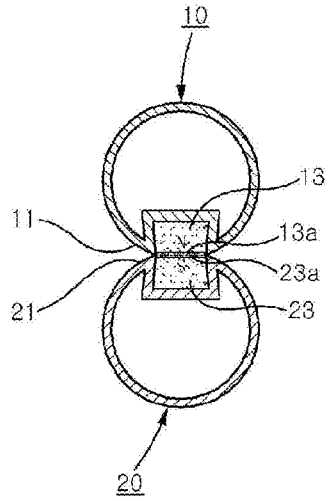

When the protruding parts 11 and 21 are attached to each other by the magnetic members 13 and 23, the surface of each of the magnetic members 13 and 23 is smooth, and thus the magnetic members may slip relative to each other. Thus, as shown in FIG. 4*b*, non-woven fabric 13*a* and 23*a* is attached to the surfaces of the magnetic members 13 and 23, thus preventing the magnetic members from slipping in a lateral direction.

Figure 4C:
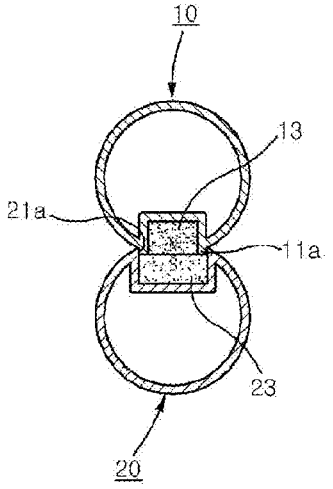

In order to prevent the magnetic members 13 and 23 from slipping in the lateral direction, as shown in FIG. 4*c*, a projection 11*a* projects slightly from one of the protruding parts 11 to support the magnetic member 13. A groove 21*a* is formed on the other protruding part 21 such that the projection 11*a* is inserted into the groove 21*a*, and the magnetic member 23 is held in the protruding part 21. Thus, when the protruding parts 11 and 21 are attached to each other by the magnetic members 13 and 23, simultaneously, the projection 11*a* is inserted into the groove 21*a*. Such a construction prevents the protruding parts 11 and 21 from slipping laterally.

As the attachment means for the protruding parts 11 and 21, magic tape 14 and 24, which is also called a Velcro fastener, may be used. As shown in FIG. 4*d*, the magic tape 14 and 24 is attached to the protruding parts 11 and 21, so that the protruding parts 11 and 21 are attached to each other.

FIG. 5*a* is a partial front view showing the state where the attachment means of the present invention is applied to the hula-hoop. Among the protruding parts 11 and 12 which protrude inward from the first and second rings 10 and 20, the magnetic member 13 is secured to each inward protruding part 11 of the first ring 10 such that the N-pole is exposed to the outside. Further, the magnetic member 23 is secured to the inward protruding part 21 of the second ring 20 such that the S-pole is exposed to the outside.

The magnetic members 13 and 23 are attached to each other, thus defining the body pressing space 30.

As shown in FIG. 5*b*, among the protruding parts 11 and 21 which protrude outward from the first and second rings 10 and 20, a magnetic member 13' is secured to each outward protruding part 11 of the first ring 10 such that the S-pole is exposed to the outside. Further, a magnetic member 23' is secured to each outward protruding part 21 of the second ring 20 such that the N-pole is exposed to the outside. Thus, as shown by the imaginary lines in the drawing, other first and second rings 10 and 20 are provided outside the first and second rings 10 and 20, so that a greater number of body pressing spaces 30 can be formed.

That is, the magnetic members 13 and 23 having opposite magnetic poles, that is, the N-pole and the S-pole, are mounted to the protruding parts 11 and 21 attached at inside positions of the first and second rings 10 and 20. Meanwhile, the magnetic members 13' and 23' are mounted to the protruding parts 11 and 21 located at outside positions such that magnetic poles, the S-pole and the N-pole, which are opposite the poles of the magnetic members 13 and 23 installed at the inside positions of the protruding parts 11 and 21, that is, the N-pole and the S-pole, are exposed to the outside.

Thus, when a person turns the hula-hoop of the present invention around his or her hips, the inner circumferential surfaces of the first and second rings 10 and 20 contacting his or her body press his or her waist in a horizontal direction. The pressing action providing pressing force in the horizontal direction is equal to that of the conventional hula-hoop.

However, the hula-hoop of the present invention performs a pressing action in a horizontal direction. Further, the waist flesh h fits into the body pressing space 30, and thus the waist flesh h is pressed in a vertical direction.

Figure 6A:
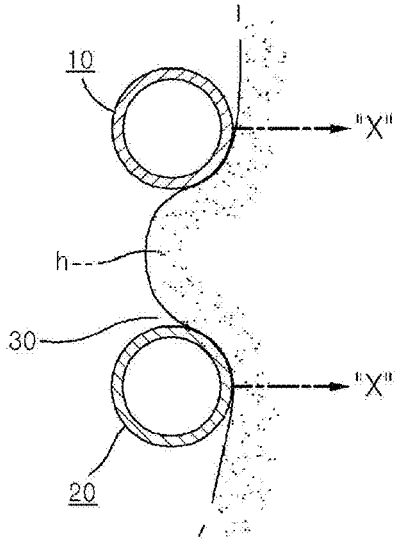
FIG. 6*a* is a sectional view taken along line A-A' of FIG. 5*a*, and illustrating the action of the body pressing space of the present invention.

That is, when the hula-hoop is turned, as shown in FIG. 6*a*, the inner circumferential surfaces of the first and second rings 10 and 20 acts as a pressing force on the waist in a horizontal direction (X direction). At this time, the waist flesh h protrudes outwards and is fitted into the body pressing space 30.

Figure 6B:
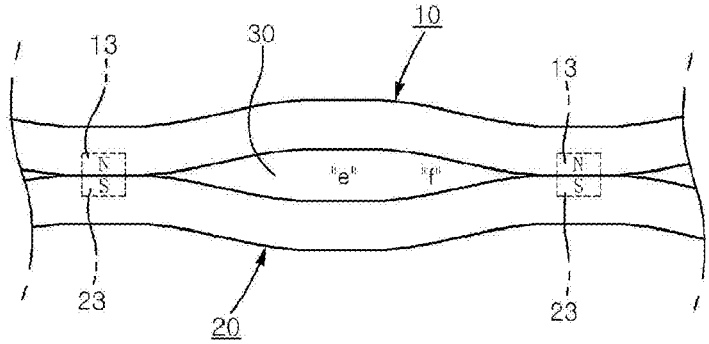
FIG. 6*b* is a front view illustrating the action of the body pressing space of the present invention.

Since the body pressing space 30 has a streamlined shape, the waist flesh h fitted into the body pressing space 30 is pushed by the first and second rings 10 and 20 at the narrow portion (portion f of FIG. 6*b*) rather than the wide central portion (portion e of FIG. 6*b*). Thereby, the waist flesh h exits the body pressing space 30.

Figure 6C:
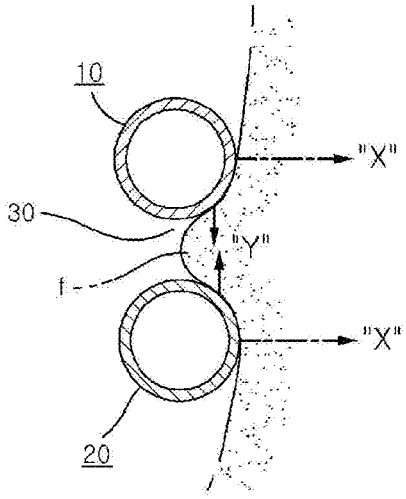
FIG. 6*c* is a vertical sectional view illustrating the action of the body pressing space of the present invention.

The waist flesh h is pushed by the first and second rings 10 and 20 from the narrow portion (portion f of FIG. 6*b*) of the body pressing space 30. At this time, as shown in FIG. 6*c*, pressing force acts on the waist flesh in the vertical direction (Y direction).

Further, since the body pressing spaces 30 are formed on the circumferential surface of the hula-hoop at regular intervals, the vertical pressing force continuously and repeatedly acts on the waist.

Therefore, the vertical pressing force continuously and repeatedly acts on the waist flesh h in the body pressing space 30, so that the waist flesh is compressed and released. Thus, the hula-hoop of the invention is helpful to reduce the fat content of the waist flesh h, and functions to massage the waist.

Figure 7:
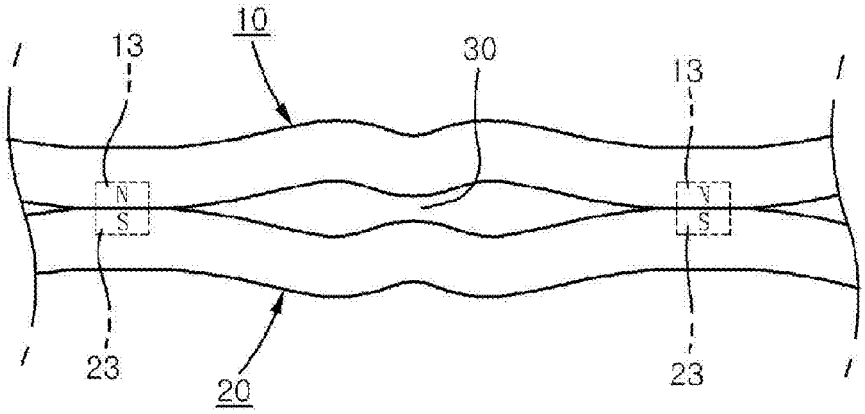
FIG. 7 is a view illustrating another body pressing space of the present invention.

When the body pressing space 30 has a more curved shape, as shown in FIG. 7, in place of the simple streamlined shape, the waist flesh is compressed twice in one body pressing space 30. Thus, the waist exercise and the massage function are more efficiently achieved.

Figure 8:
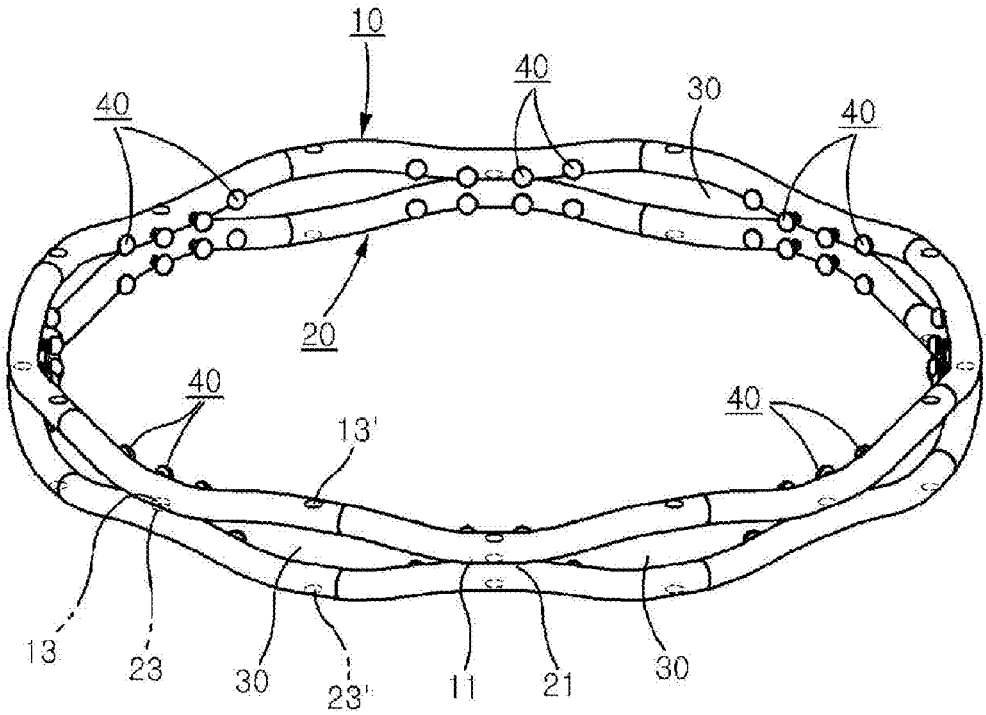
FIG. 8 is a perspective view showing the state where acupressure protrusions are mounted to the inner circumferential surface of the hula-hoop, according to the present invention.

Further, the hula-hoop of the present invention may be constructed such that acupressure protrusions 40 are mounted to the inner circumferential surfaces of the first and second rings 10 and 20, as shown in FIG. 8.

Figure 9:
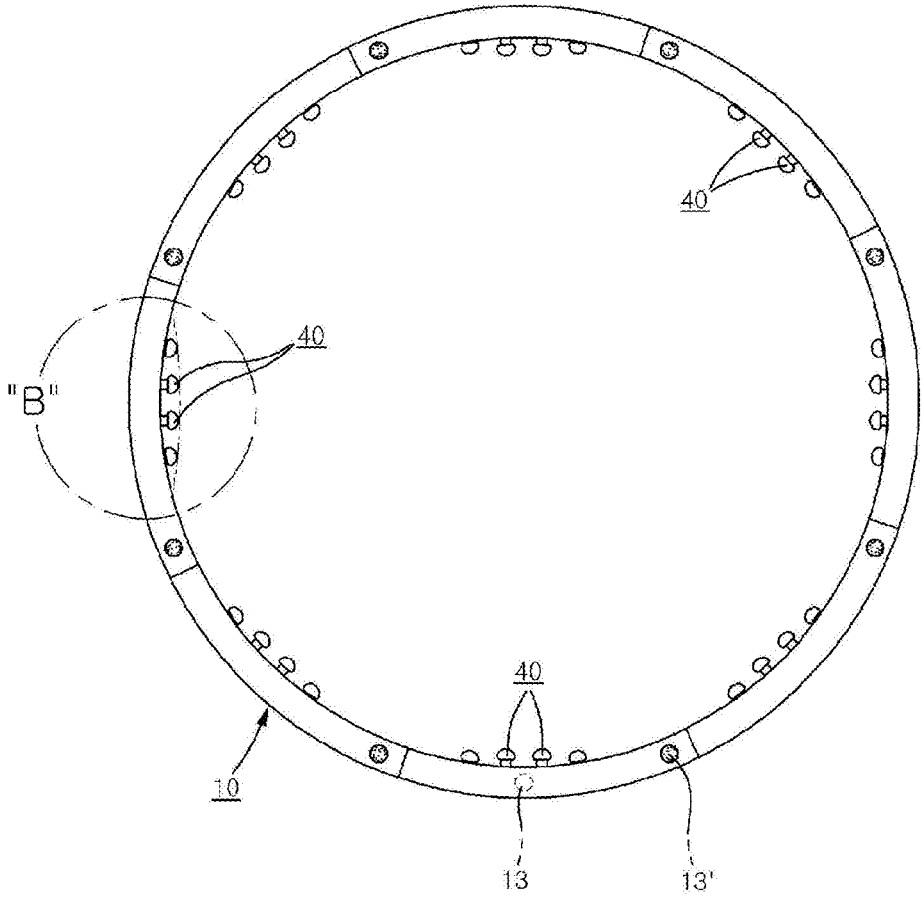
FIG. 9 is a plan view showing the state where the acupressure protrusions are mounted to the inner circumferential surface of the hula-hoop, according to the present invention.
Figure 10:
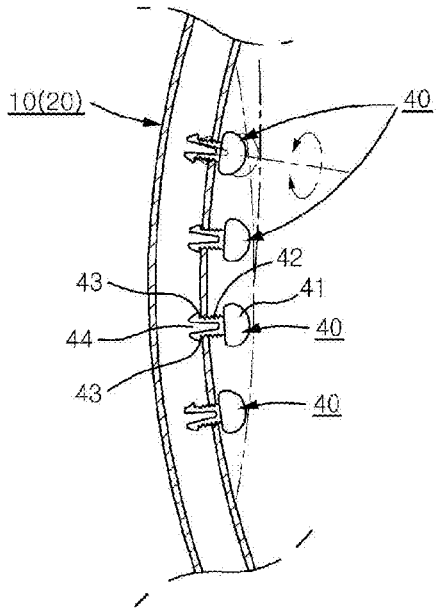
FIG. 10 is an enlarged sectional view showing portion "B" of FIG. 9.

Referring to FIGS. 9 and 10, each of the acupressure protrusions 40 is provided with an acupressure head 41. A helical shaft 42 extends rearwards from the acupressure head 41, and a stopper 43 is provided on the end of the helical shaft 42.

Reference numeral 44 denotes a split cut, so that two parts of each helical shaft 42 divided along the split cut contact each other when the helical shaft 42 is inserted into a hole.

Thus, in the state where the acupressure protrusions 40 are secured to the inner circumferential surfaces of the first and second rings 10 and 20, the acupressure protrusions 40 are rotated leftwards or rightwards. At this time, the acupressure protrusions 40 go into or come out from the inner circumferential surfaces of the first and second rings 10 and 20, so that the height of the acupressure heads 41 protruding from the inner circumferential surfaces of the first and second rings 10 and 20 is adjusted. In this case, each stopper 43 is stopped to the inner surface of each of the first and second rings, thus preventing the undesirable removal of the acupressure protrusion 40.

Figure 11:
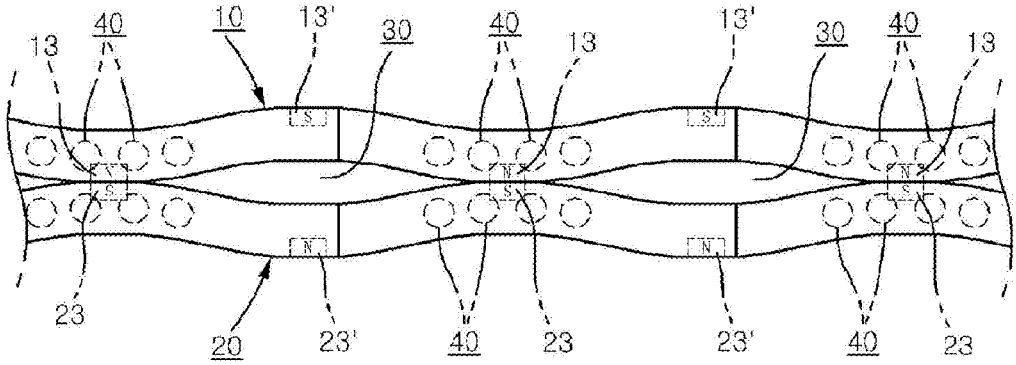
FIG. 11 is a front view showing the arrangement of the acupressure protrusions, according to the present invention.

As shown in FIGS. 10 and 11, the acupressure protrusions 40 are arranged such that the height of the acupressure heads 41 of the acupressure protrusions 40 installed on the portions of the protruding parts 11 and 21 having the magnetic members 13 and 23 is high and such that the height of the acupressure heads is gradually reduced moving away from the portions of the protruding parts having the magnetic members towards opposite sides.

Thus, when the hula-hoop is rotated, the waist flesh f is pressed via the acupressure heads 41 of the acupressure protrusions 40, and vertical pressing force acts on the waist flesh via the body pressing space 30, thus massaging the waist flesh f.

That is, immediately after the waist flesh f is massaged by the acupressure protrusions 40, the waist flesh is compressed and massaged by the body pressing space 30, so that a superior weight loss effect is achieved for the waist.

Of course, it is more preferable that magnets or jade, which are helpful to the body, be applied to the acupressure heads 41 of the acupressure protrusions 40.

Further, when the first and second rings 10 and 20 of the hula-hoop are made of a soft material and the acupressure protrusions 40 are applied to the first and second rings, a superior effect is obtained.

Figure 12:
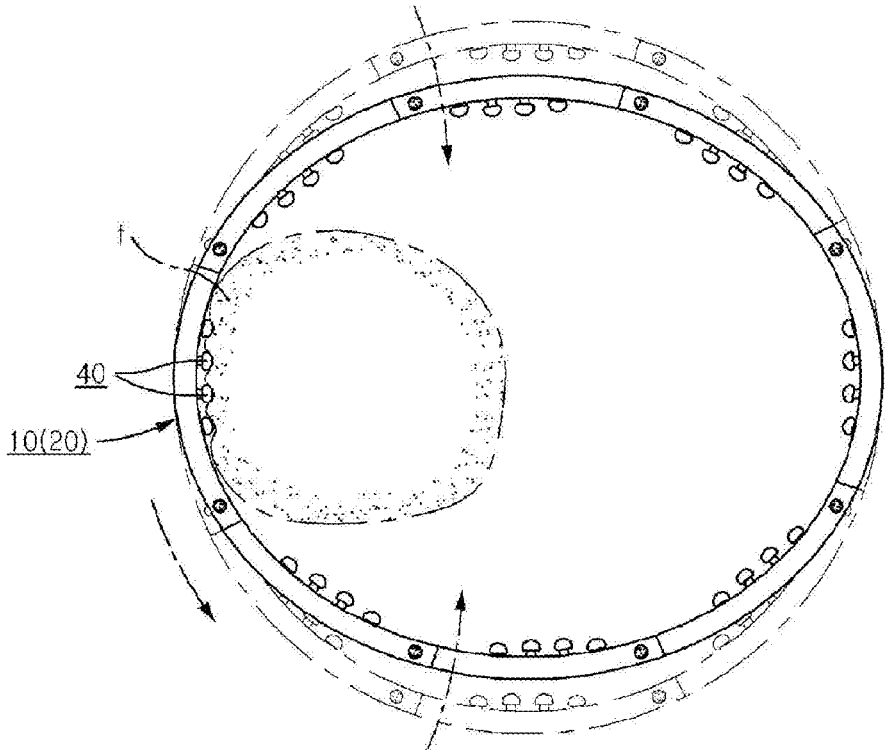
FIG. 12 is a plan view illustrating the operation of the hula-hoop and the acupressure protrusions, according to the present invention.

When the first and second rings 10 and 20 of the hula-hoop are made of a soft material, the hula-hoop is curved in an elliptical shape as shown in FIG. 12, by the centrifugal force generated during the rotation of the hula-hoop. Thereby, the hula-hoop is curved inwards, as shown by the arrows of the drawing at a portion contacting the waist flesh f.

Figure 13A:
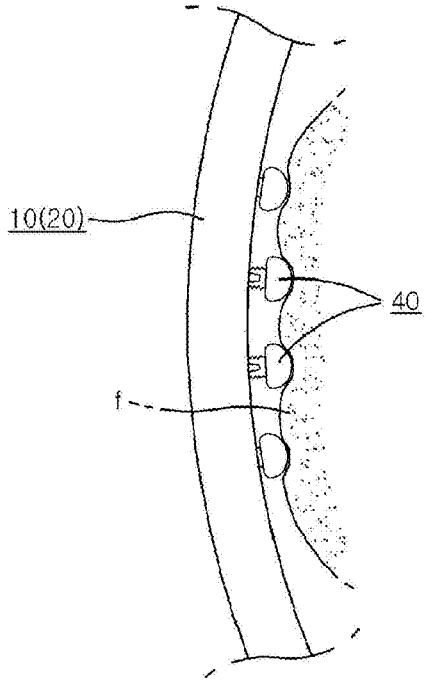
FIGS. 13*a* and 13*b* are enlarged views showing the operation of the acupressure protrusions, according to the present invention.
Figure 13B:
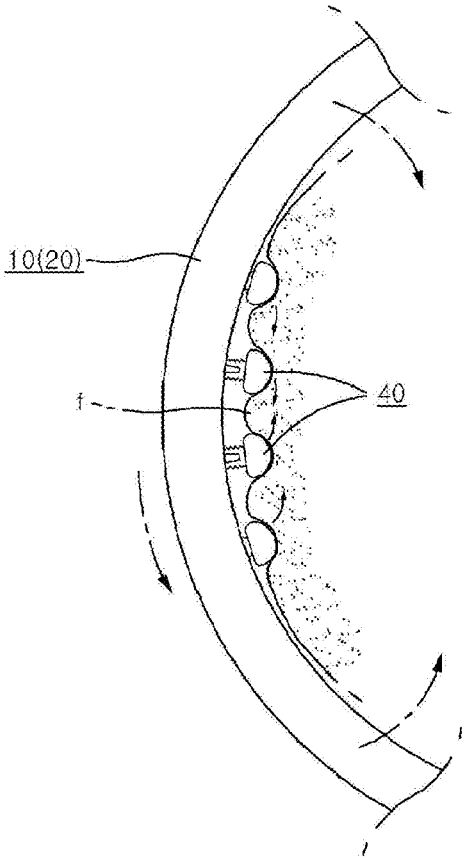

That is, when the first and second rings 10 and 20 are deformed from the state of FIG. 13*a* and are curved inwards, as shown in FIG. 13*b*, the acupressure protrusions 40 press the waist flesh h, and the acupressure heads 41 of the acupressure protrusions 40 are moved inwards. Thus, the waist flesh h existing between the acupressure heads 41 is pinched and pressed.

Figure 14:
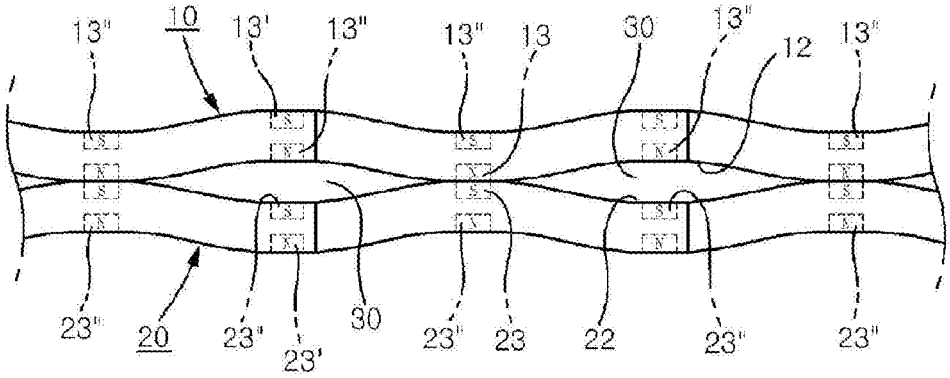
FIG. 14 is a front view showing part of a hula-hoop, according to another embodiment the present invention.

Further, as shown in FIG. 14, magnetic members 13" and 23" may be applied to the grooves 12 and 22 of the first and second rings 10 and 20 in such a way as to be secured to the grooves.

Figure 15A:
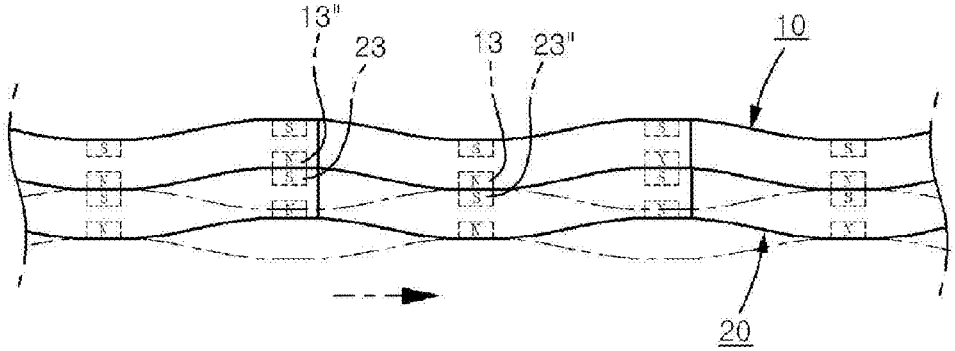
FIGS. 15*a* and 15*b* are views illustrating the use of the hula-hoop of FIG. 14.
Figure 15B:
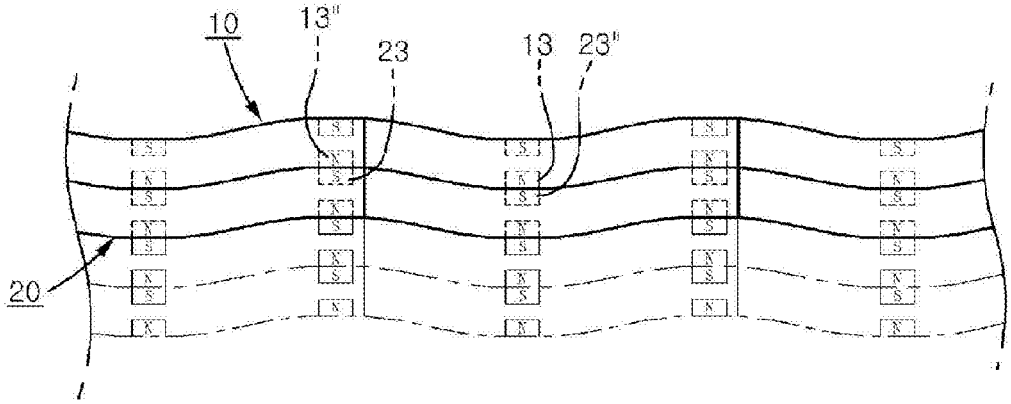

In this case, as shown in FIG. 15*a*, the second ring 20 is moved horizontally, so that the magnetic member 13" provided in each groove 12 of the first ring 10 is magnetically attached to the magnetic member 23 provided in each protruding par 21 of the second ring 20. At this time, the first and second rings 10 and 20 overlap each other, thus providing a two-step hula-hoop structure. As necessary, as shown in FIG. 15*b*, several steps may be piled up, so that a multi-step hula-hoop structure may be used.

INDUSTRIAL APPLICABILITY

As described above, the present invention provides a hula-hoop, which provides horizontal pressing force as in the prior art, and in addition, provides vertical pressing force using a body pressing space, thus massaging the flesh of the waist, and which presses the waist flesh while it is pinched by acupressure protrusions, thus achieving a superior exercise effect for the muscles of the waist and a weight loss effect for the waist, and which has a multi-step structure as necessary.

The invention claimed is:

1. A hula-hoop for pressing the flesh of the waist in a vertical direction, comprising:

first and second rings stacked on top of each other in a vertical direction, wherein the vertical direction is defined to be parallel to the direction of gravity when the hula- hoop is positioned horizontally pressing a portion of waist of a user;

protruding parts and grooves alternately provided along entire ring of each of the first and second rings in the vertical direction, wherein the protruding parts and grooves of each of the first and second rings are connected to each other continuously and repeatedly in an order of protruding part-groove-protruding part-groove-and-so-on, such that each of the first and second rings forms a ring that is circular when viewed above the ring and curved and sinusoidal when viewed in a direction across the ring; and streamlined and sinusoidal body pressing space defined in the vertical direction that is parallel to the direction of gravity when the hula-hoop is positioned horizontally pressing a portion of waist of the user between two vertically neighboring grooves of the first and second rings by attaching vertically approaching protruding parts to each other with means for attaching, so that the waist flesh of the user is pinched in the streamlined and sinusoidal body pressing space in the same vertical direction that is parallel to the direction of gravity when the hula-hoop is positioned horizontally pressing a portion of waist of the user, thus providing pressing force to the waist of the user in the same vertical direction that is parallel to the direction of gravity when the hula-hoop is positioned horizontally pressing a portion of waist of the user when the user turn the hula-hoop around a body part, wherein the protruding parts and the grooves of the first and second rings defining the streamlined and sinusoidal body pressing space are disposed so as to directly touch and press the waist flesh at least when the protruding parts and the grooves of the first and second rings around a central portion of the streamlined and sinusoidal body pressing space are right on the waist flesh, and wherein the streamlined and sinusoidal body pressing spaces exert sinusoidal pressure along the waist of the user in the vertical direction that is parallel to the direction of gravity when the hula-hoop is positioned horizontally pressing a portion of waist of the user, while inner portions of the first and second rings press the waist of the user in a horizontal direction that is directed into the waist flesh and perpendicular to the direction of gravity.

2. The hula-hoop as set forth in claim 1, wherein the means for attaching the inward protruding parts comprises first magnetic members secured to the first and second rings such that opposite magnetic poles are exposed, and second magnetic members are provided on outward protruding parts such that magnetic poles opposite the magnetic poles of the first magnetic members are exposed, and third magnetic members are provided on the grooves such that magnetic poles which are the same as the magnetic poles of the first and second magnetic members secured to the protruding parts provided on opposite sides of the grooves are exposed.

3. The hula-hoop as set forth in claim 2, wherein thin non-woven fabric is attached to a surface of each of the first, second, and third magnetic members to prevent slippage.

4. The hula-hoop as set forth in claim 1, wherein the protruding parts are attached by a fastener.

5. The hula-hoop as set forth in claim 1, wherein each of the first and second rings has on an inner circumferential surface thereof a plurality of acupressure protrusions, each of the acupressure protrusions comprising an acupressure head, a helical shaft extending rearwards from the acupressure head, and a stopper provided on an end of the helical shaft.

6. The hula-hoop as set forth in claim 5, wherein a height of each of the acupressure protrusions protruding from the inner circumferential surface of each of the first and second rings is adjusted to protrude only in each of the protruding parts.

* * * * *